United States Patent [19]

Tse et al.

[11] Patent Number: 4,822,452

[45] Date of Patent: Apr. 18, 1989

[54] MANUFACTURE OF WET LAID NONWOVEN WEBS

[75] Inventors: Stephen H. Tse, Midlothian, Va.; David H. Hollenberg, Neenah, Wis.; Richard L. Martin, Menasha, Wis.; James H. Manning, Appleton, Wis.

[73] Assignee: James River Corporation of Virginia, Richmond, Va.

[21] Appl. No.: 219,909

[22] Filed: Jul. 18, 1988

Related U.S. Application Data

[63] Continuation-in-part of Ser. No. 35,059, Apr. 6, 1987, abandoned.

[51] Int. Cl.[4] ..... D21H 5/12

[52] U.S. Cl. ..... 162/146; 162/157.2; 162/164.6; 162/177; 162/202

[58] Field of Search ..... 162/102, 177, 146, 157.2, 162/202, 164.6, 217

[56] References Cited

U.S. PATENT DOCUMENTS 4,049,491 9/1977 Brandon et al. ..... 162/157.2

OTHER PUBLICATIONS

E. J. Schaller, P. J. Rogers-Moses, "A Nonionic Associative Thickener", Resin Review, vol. XXXVI, No. 2, pp. 19–26.

K. G. Shaw, D. P. Liepold, "New Cellulosic Polymers for Rheology Control of Latex Paints", Journal of Coatings Technology 57, No. 727, pp. 63–72.

*Primary Examiner*—Peter Chin

*Attorney, Agent, or Firm*—William A. Aguele; Thomas H. Whaley

[57] ABSTRACT

A method for forming a fibrous web by wet-laying fibers on paper-making equipment, the web comprising staple length natural or synthetic fibers and wood cellulose paper-making fibers wherein a water furnish of the fibers is made up with an associative thickener in the absence of a conventional surfactant. A preferred associative thickener for use with hydrophobic fibers is a urethane block copolymer having a polyethylene glycol backbone, the associative thickener acting as both surfactant and thickener. With predominately cellulosic fibers, i.e. conventional wood cellulose fibers, or a mixture of conventional and contorted wood fibers, and synthetic cellulosic fibers, such as rayon, a hydroxyethyl cellulose having a long alkyl side chain is preferred. Excellent consistency of the water and fiber dispersion is obtained at relatively low viscosity with rapid drainage of water from the wire and uniform formation of the web.

13 Claims, No Drawings

MANUFACTURE OF WET LAID NONWOVEN WEBS

This is a continuation-in-part of application Ser. No. 035,059, filed Apr. 6, 1987 now abandoned.

This invention relates to an improved method for the manufacture of a uniform fibrous web comprising textile length fibers by wet forming the web on a conventional paper-making machine. In one of its more specific aspects, this invention relates to a method for forming a uniform web from an unfoamed dispersion of staple length natural or synthetic fibers in water containing a small amount of an associative thickener. In one of its still more specific aspects, this invention relates to the use of an associative thickener consisting essentially of an ethylene oxide based urethane block copolymer having alternating blocks of polyethylene glycol and polyurethane as dispersant and thickener in water as the carrier for natural and synthetic fibers. In still another of its more specific aspects, this invention relates to the use of an associative thickener consisting essentially of a hydroxyethyl cellulose having a long aliphatic side chain as the dispersant and thickener for natural and synthetic cellulosic fibers in a water carrier.

Methods for forming non-woven fibrous webs containing textile length fibers, e.g. synthetic fibers having a length to diameter ratio in the range of from about 300 to about 3000, in a wet paper-making process are known in the art. Generally, a viscous aqueous carrier comprising a dispersant and thickener is required for good dispersion of long thin flexible synthetic fibers, e.g. 1.5 denier by ¾ inch fibers. The long thin synthetic fibers tend to tangle and form flocs or knits in the finished non-woven fabric when formed from an aqueous dispersion suitable for wet-laying paper-making fibers on a paper-making machine.

Foam furnishes have been proposed as a viscous aqueous carrier medium to ensure good dispersion of the long fibers, for example, as disclosed in U.S. Pat. No. 4,049,491. While aqueous foams have been shown to be suitable carriers for staple length fibers, the high viscosity of foam results in relatively slow drainage of water from the wire of the paper-making machine. Other methods proposed for this purpose include the addition of thickeners to an unfoamed water carrier, for example, as disclosed in U.S. Pat. No. 3,098,786 wherein deacetylated karaya gum and sulfuric acid are included in the water-fiber furnish, and in U.S. Pat. No. 3,013,936 in which a synthetic fiber is modified to include available hydrophilic groups and the thickener is a water-swellable, water insoluble gum. Various water soluble polymers are disclosed as dispersing aids for staple length fibers in U.S. Pat. Nos. 3,808,095 and 3,794,557 including anionic, cationic and nonionic dispersing agents, among which is polyethyleneoxide. We have now discovered an improved method for forming fibrous webs from a water furnish containing textile length fibers which comprises the inclusion of a nonionic associative thickener in the water making up the fiber furnish. Nonionic associative thickeners have been developed primarily for use in the formulation of latex paints. The urethane block copolymers are described by E. J. Schaller and P. J. Rogers-Moses, Resin Review, Vol. XXXVI, No. 2, pp 19–26, incorporated herein by reference. The hydrophobically-modified hydroxyethylcellulose nonionic associative thickeners are described by K. G. Shaw and D. P. Liepold, Journal of Coatings Technology 57, No. 727, pp 63–72 (August, 1985), incorporated herein by reference. In latex paints, associative thickeners are used to give the formulation certain desirable properties, e.g., enough viscosity to resist running and over-spreading; spatter resistance; and improved leveling properties. We are not aware of any prior art in which these nonionic associative thickeners have been used in the manufacture of a water laid fabric web.

In the process of this invention, a dispersion of fibers in water is made up with a small amount of an associative thickener which acts as both a surfactant (or dispersant) and as a thickener, slightly increasing the viscosity of the water carrier medium and acting as a lubricant for the fibers. One class of nonionic associative thickeners preferred in the process of this invention comprises relatively low (10,000 to 200,000) molecular weight ethylene oxide based urethane block copolymers and is disclosed in U.S. Pat. Nos. 4,079,028 and 4,155,892, incorporated herein by reference. These associative thickeners are particularly effective when the fiber furnish contains 10 percent or more staple length hydrophobic fibers. Commercial formulations of these copolymers are sold by Rohm and Haas, Philadelphia, PA, under the trade names Acrysol RM-825 and Acrysol Rheology Modifier QR-708, QR-735 and QR-1001 which comprise urethane block copolymers in different carrier fluids. Acrysol RM-825 is a 25 percent solids grade of polymer in a mixture of 25 percent butyl carbitol (a diethylene glycol monobutyl ether) and 75 percent water. Acrysol Rheology Modifier QR-708, a 35 percent solids grade in a mixture of 60 percent propylene glycol and 40 percent water, has been found to produce excellent results in test runs as reported in Examples 1 and 2, below.

Similar copolymers in this class, including those marketed by Union Carbide Corporation, Danbury, Conn. under the trade names SCT-200 and SCT-275 and by Hi-Tek Polymers under the trade name SCN 11909, are useful in the process of this invention.

Another class of associative thickeners, preferred for making up fiber furnishes containing predominantly cellulosic fibers, e.g., rayon fibers or a blend of wood fibers and synthetic cellulosic fibers, such as rayon, comprises modified nonionic cellulose ethers of the type disclosed in U.S. Pat. No. 4,228,277, incorporated herein by reference, and sold under the trade name Aqualon by Hercules Incorporated, Wilmington, Delaware. Aqualon WSP M-1017, a hydroxyethyl cellulose modified with a $C_{10}$ to $C_{24}$ side chain alkyl group and having a molecular weight in the range of 50,000 to 400,000 was found to be particularly effective for the preparation of fiber furnishes comprising rayon fibers, as illustrated in Example 3.

We have found that the urethane block copolymers described hereinabove are effective as a thickener and dispersant for the preparation of fiber furnishes containing textile length hydrophobic fibers, for example, polyester, acrylic, polyamide, polyolefin, and modified acrylic fibers in a water carrier. The nonionic urethane block copolymers are of especial importance in the preparation of unfoamed fiber in water furnishes containing textile length hydrophobic fibers alone or in admixture with cellulosic papermaking fibers. The modified nonionic cellulose ethers described hereinabove are particularly useful in the preparation of fiber furnishes in which the textile length fibers are cellulosic fibers, e.g. rayon fibers, alone or in admixture with natural wood fibers and similar cellulosic fibers suitable for use in making paper. Although conventional papermaking fibers are preferred in such mixtures, high bulking fibers which have been subjected to chemical or mechanical treatment, e.g. caustic treatment or high energy wet or dry milling, to kink and curl the fibers may be included in the furnish.

The hydrophobic fibers forming the aqueous dispersion and the ultimate fabric may comprise from about 10 to about 100 percent by weight of staple length fibers and from 0 to 90 percent conventional wood fibers. Synthetic fibers in the size range of 1 to 4 denier by ¾ to 1.5 inch are preferred. Suitable textile fibers include polyester fibers, e.g. those sold under the trade names Trevira, Dacron, Kodel, Fortrel, etc.; acrylic fibers, e.g. those sold under the trade names Creslan, Acrilan, Orlon, etc.; polyamide fibers, e.g. nylons; polyolefin fibers, e.g. polypropylene; and modified acrylic fibers including those sold under the trade name Dynel. Inorganic fibers, including glass fibers may comprise part or all of the textile length fibers. Any of the wood cellulose fibers may be used with either type nonionic associative thickener; those comprising or consisting essentially of soft wood fibers are preferred. Other fibers may be used in conjunction with or instead of wood cellulose fibers. In addition to rayon, other known cellulosic fibers, e.g. cotton linters, may be used in the process. The modified nonionic hydroxyethyl cellulose associative thickeners are, however, relatively ineffective for dispersion of hydrophobic fibers.

For best results, the wood cellulose pulp is dispersed in water prior to adding the associative thickener, followed by the addition of the associative thickener in an amount in the range of from 1 to 150 pounds per ton of dry fiber making up the furnish and then the addition and dispersion of the staple length fibers. Finally, the dispersion of mixed fibers in an unfoamed water carrier is diluted to the desired headbox consistency and dispensed onto the forming wire of a conventional papermaking machine. An anti-foam agent may be added to the dispersion to prevent foaming, if necessary, and a wetting agent may be employed to assist in wetting the staple length fibers if desired.

The fibers preferably are made up into an aqueous dispersion suitable for wet forming on a moving wire former in the following manner. The wood pulp is first dispersed in water or in recycled white water to a consistency of about 1 to 2 percent. Then a nonionic associative thickener is added to the resulting slurry in an amount within the range of about 100 to 500 ppm, preferably in the range of 25 to 120 ppm, followed by the addition of the textile length fibers with continuous mixing under low shear conditions. After the fibers are thoroughly blended, the slurry is further diluted with fresh water and white water to the final headbox furnish consistency, preferable to a consistency in the range of 0.01 to 0.5 percent with a nascent viscosity in the range of 1.21 to 2.54 centipoises, and supplied to the headbox of a papermaking machine. A non-woven fabric web may be formed from a staple length textile fiber furnish on high speed conventional Fourdrinier papermaking machines to produce a strong, uniform product of excellent formation.

In making up the fiber dispersion containing the staple length fibers, low shear agitation, as provided by a non-stapling agitator is preferred to avoid tangling of the long fibers. As illustrated in Example 2, a small amount of a conventional polymer thickener may be added to the dispersion to more precisely control drainage of which water from the wire during web formation. While a number of nonionic polymers may be used for this purpose, the anionic polymer sold under the trade name Hydraid 7300-C by Calgon Inc., Pittsburgh, Pa. is particularly effective at concentrations of the order of 100 ppm. A defoamer, e.g. the product sold under the trade name DF-122 by Diamond Shamrock Company may be added, if required, during the preparation of the fiber furnish to eliminate foam formation in the dispersion.

A number of advantages result from dispersion of staple length fibers in a water solution of a nonionic associative thickener as compared with dispersions in foam or water containing surfactants and conventional polymer thickeners. The lower nascent viscosity of the aqueous carrier composition of this invention, as compared with prior art processes employing conventional thickeners and surfactants, results in higher drainage rates through the forming wire and permits formation on conventional Fourdrinier machines at high wire speeds. In contrast to prior art processes, special machines with sloping wires and conforming headboxes are not required for operation of our process. The dispersion is neither excessively thickened nor foamed, making it possible to handle the dispersion with conventional centrifugal pumps and to use conventional headboxes and forming wires, and to operate such equipment at high wire speeds. Good dispersion of the fibers is obtained without the need for high energy pulping equipment. Additionally, the total chemical usage is lower in the process of this invention than for processes currently used for forming non-woven fabric webs from staple length fibers.

The following examples further describe and illustrate the process of this invention.

EXAMPLE 1

A batch fiber-water dispersion was made up with 6000 pounds of water in a mix tank equipped with a nonstapling agitator by adding in the following order: a) 46 pounds of West Coast bleached softwood slush pulp at 36% solids; b) 1.6 pounds of nonionic associative thickner, Acrysol QR-708, 34% active (Rohm and Haas Philadelphia, PA); and c) 16.5 pounds of polyester staple, 1.5 denier×¾-inch (Hoechst Trevira Type 101 SD OW). The mixture was agitated for 20 minutes and then pumped with a centrifugal pump to the exit side of a fan pump where it was diluted to 0.08% consistency with white water at 100° F. containing 82 ppm Acrysol QR-708 and 3 ppm Foammaster Defoamer DF-122 (a product of Diamond Shamrock). The nascent viscosity of the water in the mix chest and of the white water was 1.2 centipoises. The dispersion was formed on an inclined wire former producing a non-woven web with good formation. Physical properties of the product web are shown in Table II below.

EXAMPLE 2

A trial run was made with a furnish of 60 weight percent of Marathon Northern Softwood blended kraft pulp and 40 weight percent 1.5 denier×¾-inch polyester fibers. A 4000 gallon capacity hi-lo pulper was used to break up dried sheets of the bleached kraft pulp. Three thousand gallons of fresh water heated to 88° F. was added first, then 300 pounds of the pulp was added. The pulp was dispersed by using both high and low agitators for 25 minutes. Then 20 pounds of Acrysol QR-708

(34% active) was dissolved in five gallons of water at 160° F. and added to the pulper followed by the addition of 140 gallons of Calgon's Hydraid 7300-C made to 0.58 volume percent solution in water at 70° F. Then 200 pounds of Hoechst Trevira polyester (1.5 denier × ¾-inch) was added while only the lower agitator mixed the stock. Since some foam appeared, one pint of Diamond Shamrock's Defoamer DF-122 was added and the entire mix pulped for 20 minutes. It was then pumped with a centrifugal pump to a mix chest where it was diluted with another 4000 gallons of fresh water at 88° F. The mix from the mix chest was then pumped with a centrifugal pump to the machine chest without further dilution. The dispersion from the machine chest was pumped to the headbox of a wire former with a centrifugal pump where it was diluted to 0.065% consistency with white water which contained 100 ppm Acrysol QR-708 and 100 ppm Hydraid 7300-C. Table I lists the viscosity data obtained during the trial using the UL attachment to a Brookfield viscometer and Table II, below, lists the physical properties of the product web.

TABLE I

Nascent Vascosity of Water Carrier

| Location and Description | Viscometer Temp. °F. | Viscosity cp |
|---|---|---|
| Pulper - water only | 62 | 1.20 |
| Pulper - QR-708 200 ppm | 63 | 1.21 |
| Pulper QR-708 (200 ppm) and 7300-C (200 ppm) | 62 | 2.54 |
| Machine chest QR-708 (100 ppm) 7300-C (100 ppm) | 62 | 1.49 |
| Headbox QR-708 (100 ppm) 7300-C (100 ppm) | 63 | 1.38 (1) |

(1) The headbox viscosity was lower than the machine chest viscosity because of dilution of the stock to the headbox with plain water.

EXAMPLE 3

Approximately fifty 30 lb/rm handsheets consisting of 70% 1.5 denier × ½ inch rayon fibers and 30% Ontario soft wood kraft pulp were made on an M/K Systems, Inc. Series 8000 Computerized Sheet Former consisting of three main components: the Sheet Former itself with its Forming and Pressing/Drying sections, a 200-liter stock tank, and a Hewlett Packard HP-85 desk top computer which controls the operation of the Sheet Former.

In a valley beater, 269 grams of wet wood pulp was mixed with 23 liters of cold tap water for ten minutes and removed to the stock tank of the Sheet Former where it was added to approximately 80 liters of cold tap water. The wood pulp stock was added to the water and air agitation from a ring at the bottom of the tank was begun. To this was added 1160 grams of a 1% by weight solution of Aqualon WSP M-1017 (90 parts per million for the 180 liter total volume of the stock). When foaming was observed in the stock tank, 1.5 ml. of Foam Master 122 (defoamer) was added and the foaming subsided.

In the same valley beater containing approximately 10 liters of cold tap water, 460 grams of the 1% solution of Aqualon were added (200 parts per million for 23 liters), mixing was begun and foam developed. Ten drops of Foam Master 122 were added and the foam disappeared. Then 245 grams of the rayon were added slowly. Cold tap water was also added to make up 23 liters of water. This mixture was beat for fifteen minutes and then removed to the stock tank of the Sheet Former.

After the rayon stock from the beater was added to the stock tank, cold tap water was added to make up the total volume of water to 180 liters. The temperature of the mixture in the stock tank was 14° C. or 57° F.

On the Sheet Former program, fresh water addition was 10 seconds; white water addition 7 seconds; stock addition 8 seconds; agitation time, 30 seconds; and settling time was 5 seconds. The average drainage time for each sheet was 10.1 seconds.

In the Pressing/Drying section, the press pressure was set at 20 psi and the felt tension was set at 20 psi.

The physical properties of the handsheet are summarized in Table II.

TABLE II

Physical Properties of Nonwoven Sheets

| | Example 1 | Example 2 | Example 3 |
|---|---|---|---|
| Basis Wt. lb/3000 ft | 33.4 | 39.9 | 32.1 |
| Caliper, mils 3 ply | 58.8 | 44 | 32.8 |
| Dry Strip Tensile, MD | 1224 | 3430 | 2034 |
| g/3-inch CD | 887 | 2380 | NA |
| Elmendorf, tear grams MD | 54.2 | NA | 57 |
| CD | 78.8 | NA | NA |
| Frazer air Permeability, $ft^3/min/ft^2$ 0.5 inch water ΔP | 199.2 | 84.3 | 105.9 |

We claim:

1. A method for the preparation of a fibrous web comprising textile length fibers which comprises forming a fiber furnish by dispersion of said fibers in an unfoamed carrier medium consisting essentially of water and an associative thickener selected from the group consisting of ethylene oxide based urethane block copolymers and hydroxyethyl cellulose ethers have a $C_{10}$ to $C_{24}$ alkyl side chain in an amount within the range of from about 1 to about 150 pounds thickener per ton of dry fiber, and supplying unfoamed fiber furnish at a consistency in the range of 0.01 to 0.5 weight percent fibers to the wire of a papermaking machine forming a fibrous web.

2. A method as defined in claim 1 wherein the associative thickener is an ethylene oxide based urethane block copolymer having a molecular weight in the range of from about 10,000 to about 200,000.

3. A method as defined in claim 1 wherein the associative thickener is a hydroxyethyl cellulose ether having a long alkyl side chain and a molecular weight in the range of from about 50,000 to about 400,000.

4. A method as defined in claim 1 wherein the associative thickener content in the fiber furnish is in the range of about 3 to about 50 pounds per ton of fiber based on the dry weight of the fibers.

5. A method as defined in claim 1 wherein the active associative thickener concentration in the liquid phase of the fiber furnish is in the range of 10 to 120 ppm.

6. A method as defined in claim 1 wherein said web is composed exclusively of textile length fibers.

7. A method according to claim 1 wherein said web is composed of a mixture of natural cellulosic fibers and textile length fibers.

8. A method as defined in claim 1 wherein said web is composed of a mixture of cellulose papermaking fibers and textile length synthetic fibers.

9. A method as defined in claim 1 wherein the textile length fibers comprise at least 10 weight percent of the web.

10. A method as defined in claim 1 wherein the web is composed of 10 to 100 parts by weight textile length fibers interspersed with 90 to 0 parts by weight cellulosic fibers.

11. A method as defined in claim 1 wherein said carrier medium contains a defoaming agent sufficient to prevent foaming of the fiber furnish.

12. A method as defined in claim 1 wherein the nascent viscosity of the aqueous carrier is in the range of 1.21 to 2.54 centipoises.

13. In a process for manufacture of a wet laid fibrous web from an unfoamed dispersion of papermaking fibers in an aqueous carrier medium, the improvement which comprises forming an unfoamed fiber in water furnish containing from 1 to 50 pounds per ton of dry fiber of a nonionic associative thickener selected from the group consisting of ethylene oxide based urethane block copolymers having a molecular weight in the range of from about 50,000 to about 500,000 and hydroxyethyl cellulose ethers having a $C_{10}$ to $C_{24}$ alkyl side chain and a molecular weight in the range of from about 50,000 to about 400,000, and forming the wet laid web from the resulting unfoamed fiber furnish.

* * * * *

UNITED STATES PATENT AND TRADEMARK OFFICE

CERTIFICATE OF CORRECTION

PATENT NO. : 4,822,452

DATED : April 18, 1989

INVENTOR(S) : Stephen H. Tse, et al

It is certified that error appears in the above-identified patent and that said Letters Patent is hereby corrected as shown below:

Claim 13 should read as follows:

13. In a process for manufacture of a wet laid fibrous web from an unfoamed dispersion of papermaking fibers in an aqueous carrier medium, the improvement which comprises forming an unfoamed fiber in water furnish containing from 1 to 150 pounds per ton of dry fiber of an associative thickener selected from the group consisting of ethylene oxide based urethane block copolymers having a molecular weight in the range of from about 10,000 to about 200,000 and hydroxyethyl cellulose ethers having a $C_{10}$ to $C_{24}$ alkyl side chain and a molecular weight in the range of from about 50,000 to about 400,000, and forming the wet laid web from the resulting unfoamed fiber furnish.

Signed and Sealed this

Thirteenth Day of March, 1990

*Attest:*

JEFFREY M. SAMUELS

*Attesting Officer*

*Acting Commissioner of Patents and Trademarks*